US005248145A

United States Patent [19]

Brown

[11] Patent Number: 5,248,145

[45] Date of Patent: Sep. 28, 1993

[54] GOLF PUTTER HEAD INCLUDING SIGHTING INDICA

[75] Inventor: Jon R. Brown, Richardson, Tex.

[73] Assignee: Highpoint Golf, Inc., Dallas, Tex.

[21] Appl. No.: 833,032

[22] Filed: Feb. 10, 1992

Related U.S. Application Data

[63] Continuation-in-part of Ser. No. 197,898, May 23, 1988, Pat. No. D. 321,738.

[51] Int. Cl.[5] ..... A63B 69/36

[52] U.S. Cl. ..... 273/187.4; 273/164.1

[58] Field of Search ..... 273/183 D, 183 E, 187.4, 273/187.5, 187.6, 164.1, 164.2, 163 R, 163 A, 162 B, 186.2, 186.3

[56] References Cited

U.S. PATENT DOCUMENTS 3,880,430 4/1975 McCabe ..... 273/183 D
4,043,562 8/1977 Shillington ..... 273/164.1
4,077,633 3/1978 Studen ..... 273/164.1
4,136,877 1/1979 Antonious ..... 273/183 D
4,231,576 11/1980 Perkins ..... 273/187.4
4,458,900 7/1984 Antonious ..... 273/187.4 X
4,629,193 12/1986 Pierman ..... 273/187.4 X

*Primary Examiner*—George J. Marlo
*Attorney, Agent, or Firm*—Timmons & Kelly

[57] ABSTRACT

A golf club formed with a central open cavity behind the striking face and a linear ledge overlying the cavity. Two pair of vertically spaced sighting indicia extend in transversely intersecting planar registration for providing parallax - free alignment sighting relative to the sweet spot of a ball surface to be struck. A lower indicia of one pair extends generally longitudinally co-directional with the striking face and is comprised of three parallel laterally spaced apart indicia for sighting selectively recognized forward pressing of the golfer's hands on the club shaft.

3 Claims, 3 Drawing Sheets

GOLF PUTTER HEAD INCLUDING SIGHTING INDICA

This application is a continuation-in-part of design application Ser. No. 07/197,898 filed May 23, 1988, now Design Pat. No. D321,738.

FIELD OF THE INVENTION

The field of art to which the invention pertains includes the art of golf clubs providing sighting indicia for aiding the holder in the positioning thereof relative to a golf ball to be struck.

BACKGROUND OF THE INVENTION

When it comes to the preparation for and the actual striking of the ball with the putter head, there are at least a minimum number of factors a golfer should consider if he wishes to enhance his chances of successfully making the putt. The golfer should position the putter head such that the face of the putter head is square to the intended line of roll when the face of the putter head contacts the golf ball. Also, the golfer should strike the golf ball solidly by contacting the golf ball with the face of the putter head at the "sweet spot" of the putter head. In addition, the golfer stands such that his eyes are positioned directly above the golf ball when putting, which tends to make for better coordination between the hands and eyes of the golfer.

For the initial setup and preparation for the putting of the golf ball, nearly all golfers will set the putter head behind the golf ball such that the face of the putter head is square to the intended line of roll of the golf ball. The golfer will then swing the putter back a predetermined distance along an extension of the golf ball's intended line of roll. Finally, the golfer will swing the putter head forward such that the face of the putter head strikes the golf ball.

The length of the back swing and the force associated with the swinging the putter head forward to strike the golf ball will be dictated by the distance to be traversed by the golf ball in its travel to the cup and the slope of the putting surface along the intended line of roll. It will be appreciated that the shorter the distance of the back swing and the less force needed to be applied to the putter during the forward swinging of the putter head for a given distance to the cup, the better is the probability that the face of the putter head will remain square to the extension of the intended line of roll of the golf ball and that the "sweet spot" will remain directly above the extension. Advance alignment of the striking face is crucial to the quality of play.

DESCRIPTION OF THE PRIOR ART

The prior art teaches that the face or ball-striking surface of the putter head should have an angle of loft with respect to the vertical. The loft on the face of the putter head causes the ball-striking surface to contact the golf ball below center and apply a lift force to the golf ball. U.S. Pat. No. 3,652,093 discloses that prior art putter heads have been provided with a ball-striking face tipped backward at an angle of about five degrees from the vertical. The putter head disclosed in that patent has a ball-striking surface which is canted back from the vertical approximately ten degrees for greater loft. Also, in the golf book entitled "Golf's Winning Stroke: Putting" by Tom Michael and the Editors of *Golf Digest,* it is disclosed that about the only criteria the experts agree upon is that there must be loft built into the putter face. One of the major manufacturers of putters has determined that a putter with two-and-a-half to three degrees of loft will give the ball the best and most consistent spin off the face of the club. U.S. Pat. No. 656,099 discloses a golf club having a convex-shaped surface from the sole of the club to the top of the head. The object in giving the face the convex form is that if the ball should be in a cuppy-lie, the club will roll the ball out of the cup without giving a jump to the ball.

In the prior art, there have been various attempts to provide sighting alignment devices, targeting schemes, etc. to assist the golfer in pre - alignment of the club . For example, U.S. Pat. No. 3,880,430 discloses indicators to assist the golfer in aligning the club head relative to the golf club. U.S. Pat. No. 4,128,244 also discloses an alignment device for golf clubs which assists the golfer in aligning the club such that the golf ball is struck at the sweet spot of the club. U.S. Pat. Nos. 4,508,350 and 4,458,900 also disclose alignment means to assist the golfer in pre - alignment of the golf club.

Lacking in these prior art devices are parallax elimination in sighting and compensatory alignment for recognizing hooded or forward pressing of the hands.

OBJECTS OF THE INVENTION

It is an object of the invention to provide a golf putter having a novel sighting structure with which the user can relate in aligning the club head relative to a ball to be struck.

It is a further object of the invention to provide an improved sighting structure as in the previous object affording parallax elimination in the course of sighting.

It is a still further object of the invention to effect the previous objects while also affording compensatory or recognized alignment for hooded or forward pressing of the hands.

It is yet another object of the invention to effect the previous objects with a relatively uncostly head structure in which such features are incorporated.

SUMMARY OF THE INVENTION

The present invention relates in general to golf clubs. More particularly, the present invention relates to a line of sight alignment feature for a putter head which assists the user of the putter to contact the golf ball with the "sweet spot" of the putter head and to maintain the ball-striking surface of the putter head at the proper angle.

The foregoing is achieved in accordance with the invention by a putter head having a narrow and elongated top wall defining a ledge extending horizontally heel to toe and laterally rearward from the striking face partially overhanging a central cavity. Laterally inscribed in the top surface of the top wall is a first indicia vertically aligned in registration with a second laterally inscribed indicia in the bottom surface of the cavity and aligned paired together in a plane extending behind the sweet spot on the striking face. The rear face of the ledge extends longitudinally co-directionally with the striking face and represents another indicia paired together vertically aligned in another plane with an elongated second indicia inscribed longitudinally on the bottom surface of the cavity. With the latter second indicia comprising a plurality of indicia laterally spaced and parallel to each other, at least some can be utilized in sighting to recognize or compensate for hooded or forward pressing of the hands.

In this arrangement, the spaced apart locations of the first paired indicia provide for a parallax free lateral sighting of the sweet spot relative to the ball. At the same time the back face of the ledge and second indicia within the recess are paired for a parallax free parallel sighting of the striking face relative to the ball. Yet, the plurality of indicia comprising the latter second indicia can be readily resorted to for recognizing or compensating for hooding a forward pressing. In this manner, any offset or misorientation can be readily detected and immediately corrected prior to the forward swing so as to enhance the quality of the golfer's play.

Examples of the more important features and advantages of this invention have thus been summarized rather broadly in order that the detailed description thereof that follows may be better appreciated. There are, of course, additional features of the invention that will be described hereinafter and which will also form the subject of the claims appended hereto. Other features of the present invention will become apparent with reference to the following detailed description of a presently preferred embodiment thereof in connection with the accompanying drawings in which:

DESCRIPTION OF THE PREFERRED EMBODIMENT

Figure 1:
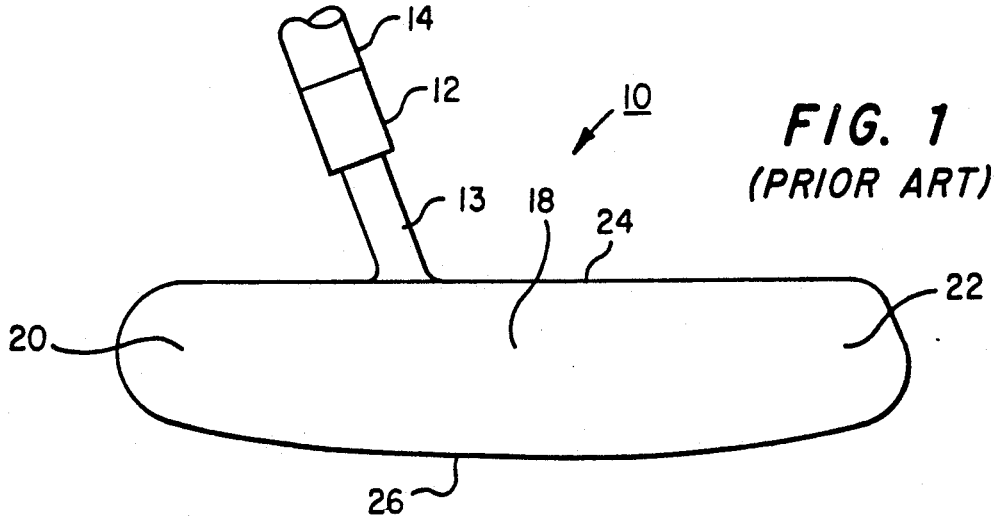
FIG. 1 (PRIOR ART)
FIG. 1 is a simplified side elevational view of a conventional prior art putter head of a center-shafted blade-type.

In the description which follows like parts are marked throughout the specification and drawings with the same reference numerals respectively. The drawing figures are not necessarily to scale and the proportions of certain parts may have been exaggerated for purposes of clarity.

Figure 2:
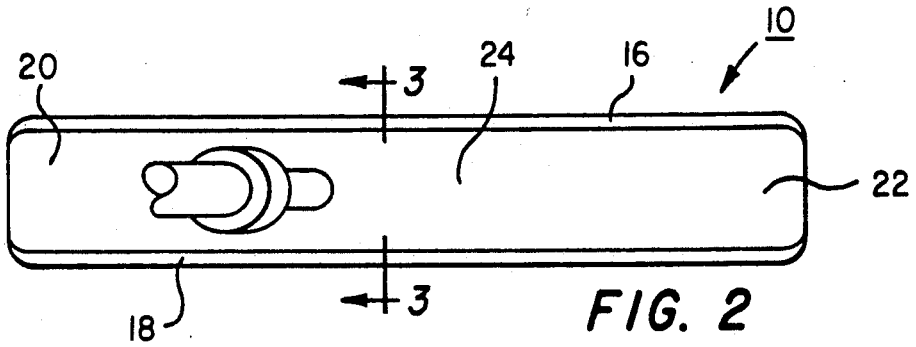
FIG. 2 (PRIOR ART)
FIG. 2 is a simplified top plan view of the prior art putter head of FIG. 1.
Figure 3:
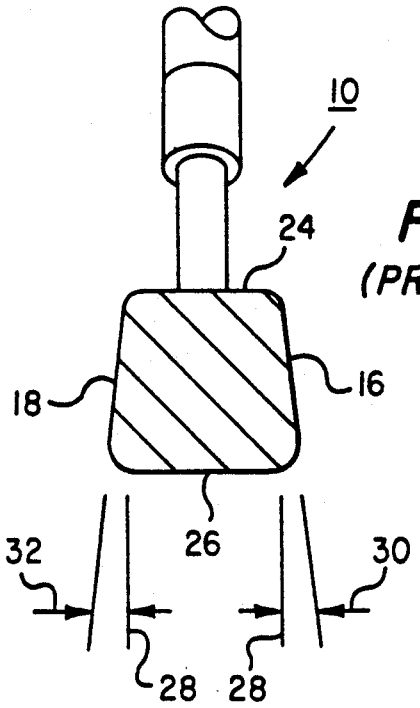
FIG. 3 (PRIOR ART)
FIG. 3 is a simplified front elevational view, in section, of the prior art putter head of FIG. 2, taken along lines 3—3 of FIG. 2.
Figure 4:
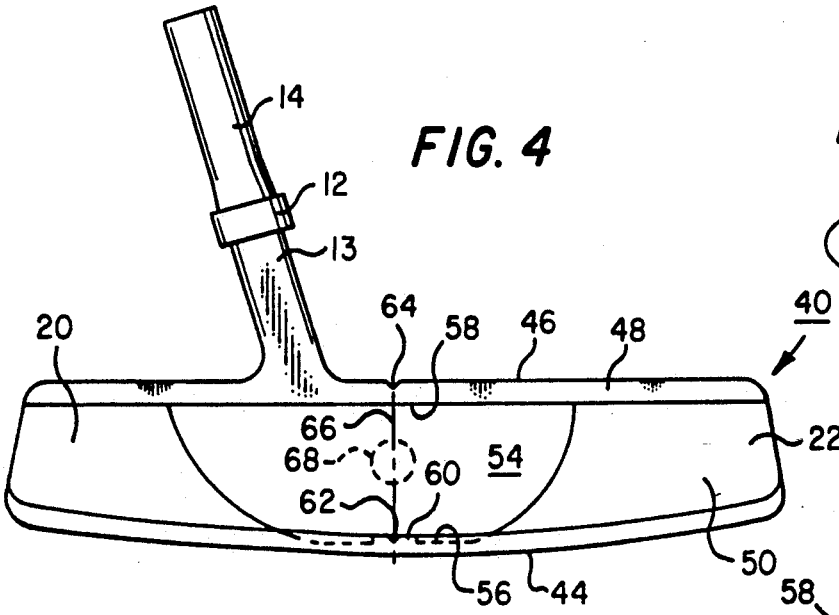
FIG. 4 is a backside elevation of a putter head in accordance with the invention.
Figure 7:
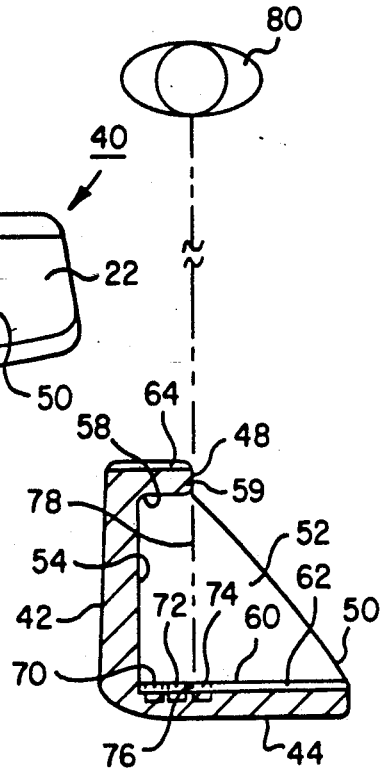
FIG. 7 is a sectional elevation taken substantially along the lines 7—7 of FIG. 6.
Figure 6:
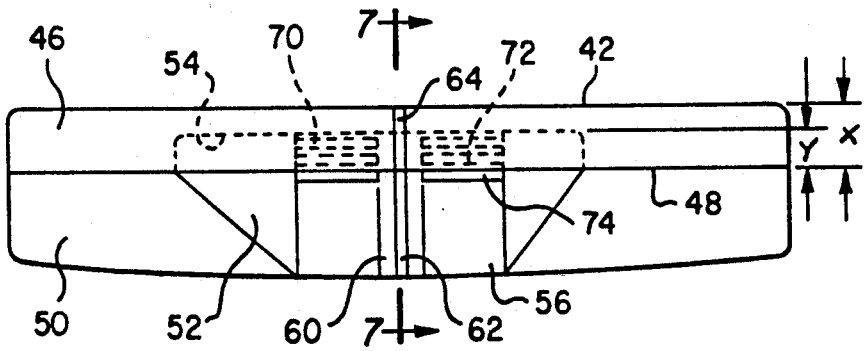
FIG. 6 is a top plan view of the putter head of FIG. 4.
Figure 5:
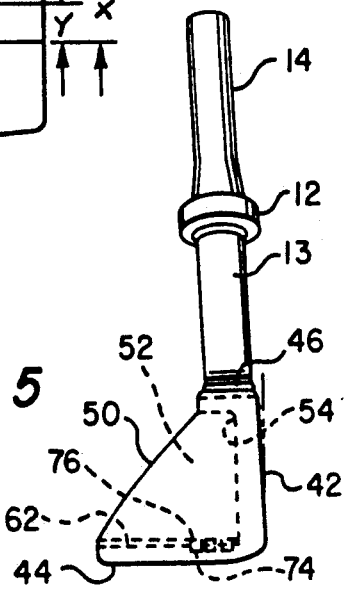
FIG. 5 is an end elevation of the putter head of FIG. 4.

Referring now to FIGS. 1, 2 and 3 there is disclosed a putter head 10 indicative of conventional putter heads of the prior art. The putter head 10 includes a hosel 12 connecting neck 13 to the lower end of shaft 14. The lower end of neck 13 is integrally formed with the head proper which includes a first face or ball-striking surface 16, a second face or ball striking surface 18, a heel portion 20, a toe portion 22, a top surface 24 and the sole or sole surface 26.

It will be appreciated that putter head 10 is configured such that it may be used by either a right-handed or left-handed golfer with the right-handed golfer using the first face or ball-striking surface 16 while the left-handed golfer would use the second face or ball-striking surface 18. It will also be appreciated that the weighted heel-and-toe type putter head normally only has one face or ball-striking surface.

With the conventional prior art putter head 10, the first face or ball-striking surface 16 and the second face or ball-striking surface 18 are lifted or canted back from the vertical (line or plane) 28 by the angle or angles of loft 30 and 32, respectively. The loft angles 30 and 32 typically vary between two-and-a-half to ten degrees. With the ball-striking surface or surfaces being canted, the golf ball is contacted below the center or centerline when struck or contacted by the ball-striking surface of the putter head in its forward stroke.

Referring now to FIGS. 4–7 there is disclosed the putter head of the invention designated 40. Comprising the head 40 is a canted striking surface 42 having a loft angle of about two degrees vertically extending between the sole surface 44 and a relatively narrow top surface 46. The latter terminates laterally inward at a vertically disposed rectangular- face 48 so as to define a ledge 59 as will be understood.

Centrally formed in the back face 50 is a cavity 52 extending inward to vertical face 54 and extending vertically between a bottom surface 56 and a lateral undersurface 58 of the overhanging ledge 59. For these purposes, top surface 46 is of dimension "X" typically on the order of about 11/32 inches and the inward depth of surface 58 is of dimension "Y" on the order of about 7/32 inches.

To achieve play accuracy of lateral sighting with head 40 in accordance herewith, the bottom surface 56 includes a centrally raised lateral shoulder 60 in which is provided a lateral groove 62 extending inward from the distal edge to vertical face 54. Located vertically coincident in registration with indicia groove 62 is another and paired indicia groove 64 defined in the top surface 46. In this manner the paired grooves 62 and 64 together define a vertical plane 66 aligned laterally behind the centerline of sweet spot 68.

For effecting longitudinal sighting, the edge of face 48 represents indicia with which there is provided in the bottom surface 56 of recess 54 for cooperation therewith, three separated and distinctly colored indicia grooves 70, 72 and 74. The latter indicia are interrupted by shoulder 60 but otherwise are parallel to each other and parallel to face 48. Specifically, the inner edge 76 of groove 74 is located in vertical registration with the face 48 of ledge 59 while grooves 70 and 72 afford compensatory offset for intended or recognized hooding or forward pressing of the hands as will be understood.

In use, the golfer first positions the putter head 40 with the striking face 42 adjacent a ball (not shown). With his eye 80 located above head 40 and while standing in normal putting posture, grooves 62 and 64 are visually aligned with the center of the ball in the strike path to be generated. Concomitantly, the golfer's eye 80 sights along face 48 in a plane 78 to a registration with edge 76 of groove 74 for an orientation alignment of surface 42 with respect to the strike path to be imposed. With each of the transverse and intersecting sighting planes being defined spaced apart between parallel sighting locations, the adverse possibility of parallax is eliminated. At the same time, grooves 70 and 72 are available in the golfer's discretion for those golfers who have moved or intend to move their hands forward. That is, for the latter these two additional parallel and laterally spaced grooves 70 and 72 comprise hand lines, that when aligned in registered sight with face 48 allows the golfer to recognize the amount of his hooding or forward pressing of the hands. Where forward pressing is intended, the hand lines provide a proper reference and where recognized but not intended, immediate correction can readily be made. By virtue of the hand lines, the golfer is allowed to strike the ball similarly each time thereby affording enhanced putting consistency.

Figure 10:
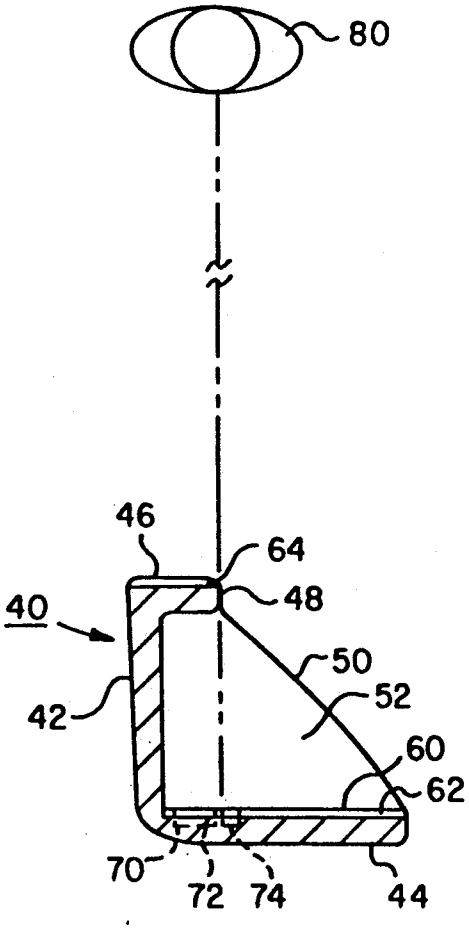
FIGS. 8, 9, and 10 are sectional elevations similar to FIG. 7 for putter heads having different striking face configurations.
Figure 9:
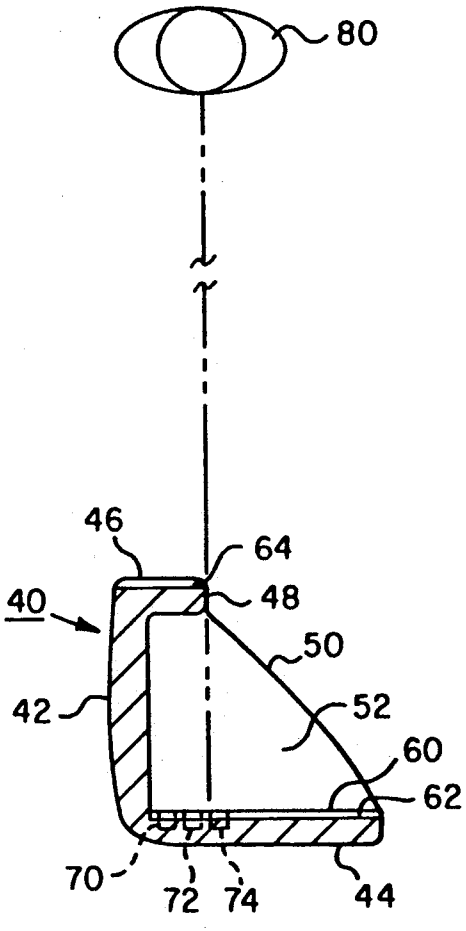
Figure 8:
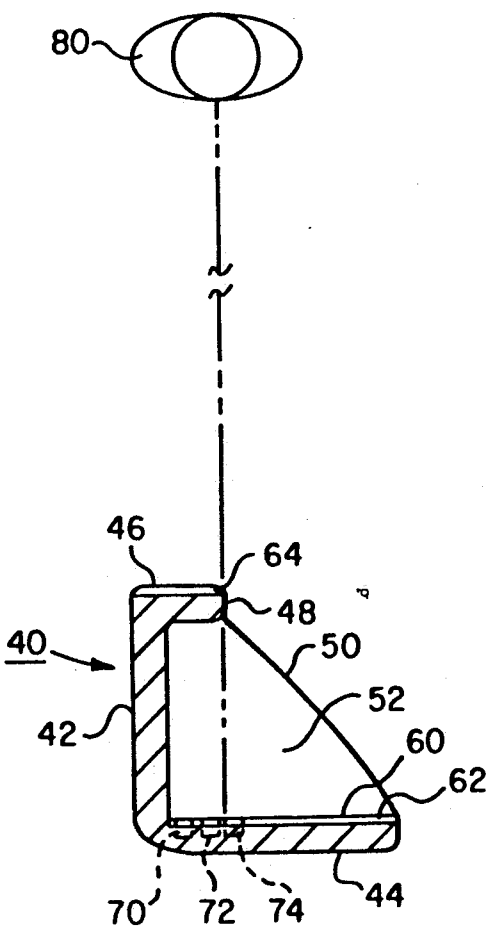

Referring now to FIG. 8, 9 and 10 there is illustrated cross sections through putter heads of operable design subject to variations in the geometry of the striking face 42. Specifically, the striking face 42 of FIG. 8 extends, perpendicular to the putting surface so as to reduce forward press since there is no loft to which to adjust. In FIG. 9, striking face is 42 is slightly rounded for creating overspin and initiating ball rolling sooner. For the embodiments of both FIGS. 8 and 9, the sighting hand lines 70, 72 with ledge face 48 lets the golfer know just how far he has moved his hands. In FIG. 10, strike face 42 has a slight reverse angle for imparting immediate overspin on the golf ball by striking it just above its center. This enables the golfer to retain his hands in a natural position and automatically obtain the benefit of forward pressing. Since the face has the forward press built into it, the hands do not need to be adjusted or hit down on a golf ball to obtain a desired overspin. With this embodiment, only first groove 74 and edge 76 are needed for longitudinal sighting. When the adjacent groove color is seen, the golfer knows his hands are too far forward.

By the foregoing description there has been described a novel putter head for golf clubs affording enhanced accuracy in positioning of the strike face with respect to a ball than comparable putter heads of the prior art. Using transversely normal indicia planes each extending between spaced apart sight locations, a relatively simple arrangement of components is able to achieve significant improvement in the playing skill of the golfer while at the same time affording a visual guide to hooded or forward pressing of the hands. Needless to say, such enhancement is a basic goal for which all golfers strive.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A golf club head adapted to be secured to a club shaft and comprising:

a first vertically oriented surface defining a ball striking face containing a sweet spot thereon;

a pair of vertically spaced apart surfaces located rearward of said striking face; and at least two pair of vertically spaced apart sighting indicia (62, 64 and 48, 76) extending in intersecting uninterrupted planes of sight (66, 78) for a golfer to orient the sweet spot on said striking face relative to a golf ball to be struck, each of said indicia sighting pairs being defined by an indicia within their respective planes on each of said spaced apart surfaces for eliminating parallax in the sighting thereof;

one pair of said sighting indicia including a first elongated indicia located on a top of said spaced apart surfaces and a second elongated indicia located on a relatively lower of said spaced apart surfaces extending parallel and in vertical registration with said first elongated indicia for said first and second indicia to be aligned in a plane disposed normal to the sweet spot;

the other pair of said sighting indicia including a first elongated indicia located on a top of said spaced apart surfaces and extending longitudinally parallel with said striking face and a second elongated indicia on a relatively lower of said spaced apart surfaces extending parallel and in selective visual registration with said first elongated indicia;

said second elongated indicia of said other pair comprising a plurality of separate elongated indicia having a predetermined lateral spacing therebetween juxtaposed and parallel to each other for selective visual alignment with the first elongated indicia thereof enabling the user of the club to visually recognize a predetermined pressing of hands on the club shaft.

2. A golf club in accordance with claim 1 in which there is provided a cavity in the backside of said club head, the lower of said vertically spaced apart surfaces is defined by a bottom surface of said cavity and the upper of said spaced apart surfaces is defined by a ledge overlying said cavity.

3. A golf club head in accordance with claim 1 in which said other indicia of said second pair of sighting indicia are color distinctive for individual visual sighting alignment with said first indicia of said other pair of sighting indicia.

* * * * *